United States Patent [19]

Hicks et al.

[11] Patent Number: 4,685,316

[45] Date of Patent: Aug. 11, 1987

[54] WINDOW GUARD LATCH WITH EMERGENCY RELEASE

[76] Inventors: Harry H. Hicks, 3680 Taylor, Bridgeton, Mo. 63044; Gerald E. Davenport, 47 Gary Glen Dr., St. Peters, Mo. 63376

[21] Appl. No.: 843,036

[22] Filed: Mar. 24, 1986

[51] Int. Cl.[4] ..... E05B 47/02; E05B 65/10; E05F 15/20; E06B 3/68

[52] U.S. Cl. ..... 70/256; 70/270; 70/279; 49/31; 49/56; 49/141

[58] Field of Search ..... 49/141, 31, 56, 41; 70/279, 256, 270

[56] References Cited

U.S. PATENT DOCUMENTS 4,258,504 3/1981 Hicks ..... 49/56
4,358,910 11/1982 Keating et al. ..... 49/56
4,539,555 9/1985 Tefka ..... 49/31

FOREIGN PATENT DOCUMENTS 0138090 4/1985 European Pat. Off. ..... 70/256

*Primary Examiner*—James L. Ridgill, Jr.
*Attorney, Agent, or Firm*—Rogers, Howell, Moore & Haferkamp

[57] ABSTRACT

A window guard latch with emergency release comprising a bracket having a channel for receiving a portion of the window guard, a lock for engaging the portion of the window guard received in the channel, the lock having a trigger for releasing the engagement with the window guard, and a solenoid linked to the trigger to operate it. A control box, mounted inside the building has an RF signal detector and means to activate the solenoid in response to the detector to release the window guard. Smoke detectors which trigger an RF transmitter and portable push button RF transmitters can transmit an RF signal to remotely activate the release mechanism.

20 Claims, 9 Drawing Figures

WINDOW GUARD LATCH WITH EMERGENCY RELEASE

BACKGROUND AND SUMMARY OF INVENTION

This invention relates to a window guard latch with an emergency release, and in particular to a guard latch having a release automatically triggered by a remote smoke detector or a hand held RF transmitter.

Guards are often mounted over windows to help prevent break-ins. These guards are typically made from metal bars, and are often embellished to enhance their appearance. To effectively prevent entry into the building, the guards must be secured against removal by would-be intruders. However, the guards pose a significant disadvantage because they also prevent exit from the building. Some local ordinances prohibit the use of window guards unless they are equipped with some type of emergency release. To allow emergency exit from the building, the guards are typically hinged at one side and some type of latch mechanism is used to releasably secure the other side of the guard to the window frame.

One type of releasable latch mechanism for securing a window guard comprises a lock box mounted to the building and having a receptacle for receiving and engaging a strike pin on the window guard. A release rod extends from the lock box through the building wall to the interior where it can be operated to release the lock mechanism. In some mechanisms the release rod is operated by turning it with a handle. In other mechanisms the release rod is operated by a mechanical push button. The push button can be provided with a safety cap with a finger opening facing away from the window to make it difficult to release the guard from the outside.

One of the inventors herein is also the inventor of a mechanical release latch mechanism disclosed and claimed in U.S. Pat. No. 4,258,504 which utilizes an armored release cable which connects between an exterior release mechanism and an interiorly mounted foot treadle for operating the latch mechanism. This design provides significant advantages over the mechanical releases of the prior art and represents a significant advance in the ability of an occupant to quickly and easily release the lock in any situation, including an emergency. This invention has been quite successful and has been adopted in many locales. However, while this device represents a significant advance, it is still desired to further improve and automate the release of window guards and the like for those emergency situations in which life threatening danger requires immediate action to exit the dwelling.

To solve these and other problems of the prior art, the inventors herein have succeeded in developing a window guard latch with an emergency release which can be automatically activated by a smoke detector, and which also provides for remotely automatic and manual operation by an operator. The latch of the present invention incorporates a manual, key operated release at the guard for local control, and an electric release which can be actuated by one or more of a number of means. A solenoid and trip hook operates the manual lock, and an RF receiver is combined with the solenoid to permit remote operation through the smoke detector as previously mentioned, in addition to a remote transmitter such as is typically used to open garage doors. In addition to operating the manual lock, the RF signal is also used to sound a local audible alarm to aurally alert the occupant of the fire. This provides additional time to the occupant to either exit the dwelling or even extinguish the fire. An important feature of the present invention is its battery back-up circuit which supplements the AC power circuit to ensure reliable operation upon failure of the electrical system in the dwelling. This battery is a Ni-Cad rechargeable battery which is continuously charged through the A.C. connection so that it is at full power in the event of an emergency. Furthermore, the lock of the present invention is constructed in modular fashion so that a simple installation can include a key lock manual release with electric push button release, and the RF link providing true remote control through the smoke detector and push button RF operator can be added on after the initial installation.

It is believed that the present invention is a significant advance over the prior art in that it provides immediate automatic release of the window guards upon a smoke detector's actuation in a simple, inexpensive design which can be readily installed in any home. It must be remembered that to a large extent these window guards and smoke detectors are often used in relatively inexpensive or crime ridden areas of a city and that elaborate systems of significant complexity and expense are not feasible for such an installation. This system is designed to overcome these problems and provide the maximum of safety and protection for the occupants of a dwelling with an absolute minimum of cost.

While the foregoing has been a brief description of some of the principal advantages and features of the present invention, a more detailed explanation follows.

DETAILED DESCRIPTION OF THE PREFERRED EMBODIMENT

Figure 1:
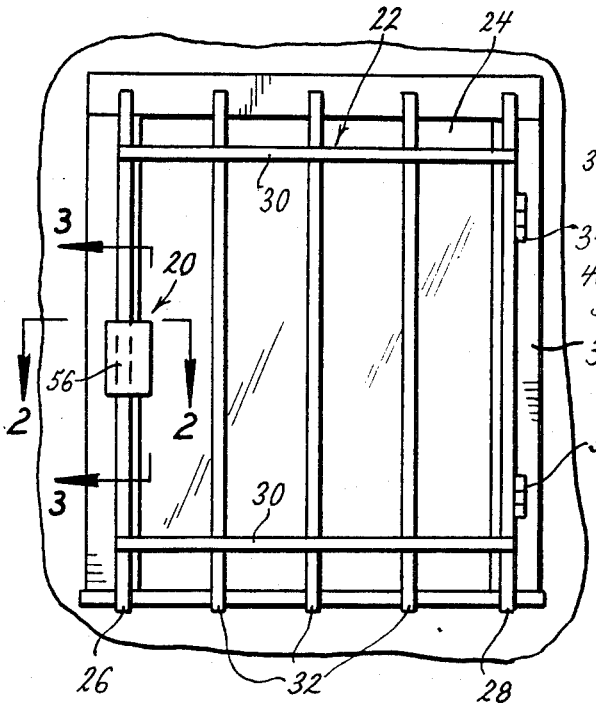
FIG. 1 is a front elevation view of a window guard as it would be hingedly mounted over a window and secured with the guard latch of this invention.

In FIG. 1, a window guard latch with emergency release constructed according to the principles of this invention, indicated generally as 20, is shown as it would be used to secure a window guard 22 over a window 24.

Guard 22 comprises a left end bar 26, a right end bar 28, and two horizontal crossbars 30 extending therebetween. A plurality of vertical bars 32 extend between the crossbars 30, in between the left and right end bars 26 and 28. Bars 26, 28, 30, and 32 are preferably made from metal and have a hollow, square cross-section. Two hinges 34 are mounted between right end bar 28 and frame 36 of window 24.

Figure 2:
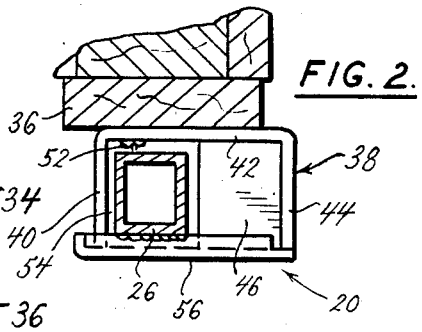
FIG. 2 is a cross-sectional view of the guard latch taken along the plane of line 2—2 in FIG. 1.
Figure 4:
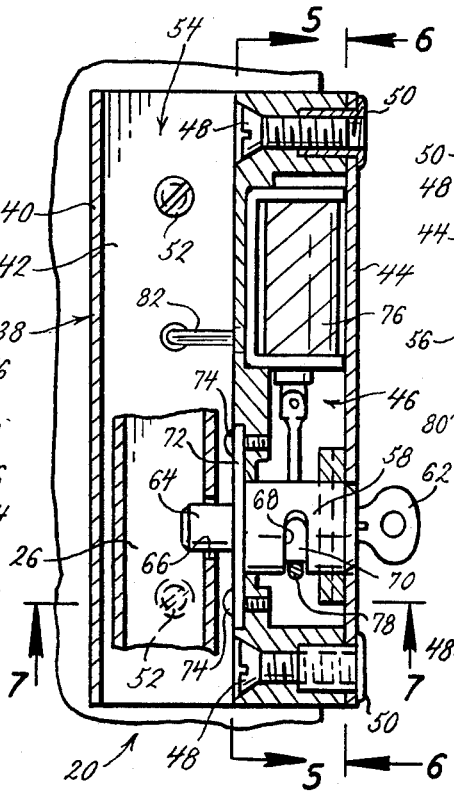
FIG. 4 is a cross-sectional view of the guard latch taken along the plane of line 4—4 in FIG. 3, showing the engagement between the lock bolt and the window guard.
Figure 3:
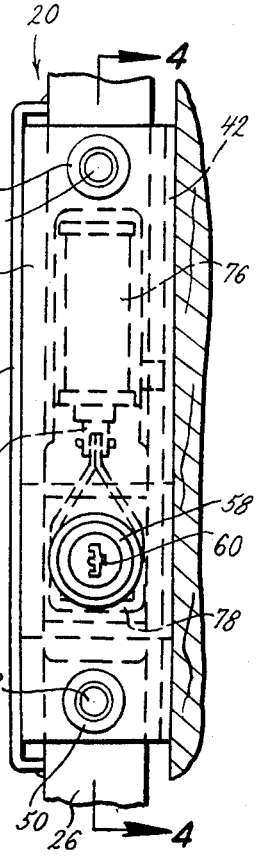
FIG. 3 is a cross-sectional view of the guard latch taken along the plane of line 3—3 in FIG. 1, showing the keyhole for manually operating the lock.

As shown in FIG. 2, window guard latch 20 comprises bracket 38 having a U-shaped cross-section with left side 40, back 42, right side 44, and an open front. A lock unit 46 is mounted in the right side of bracket 38. As shown in FIG. 4, lock unit 46 is secured to the right side 44 of bracket 38 with screws 48 which are threaded into smooth-head caps 50 extending through the right side 44 of bracket 38. The smooth head of caps 50 prevents tampering, making it difficult to loosen lock unit 46 from bracket 38.

Figure 7:
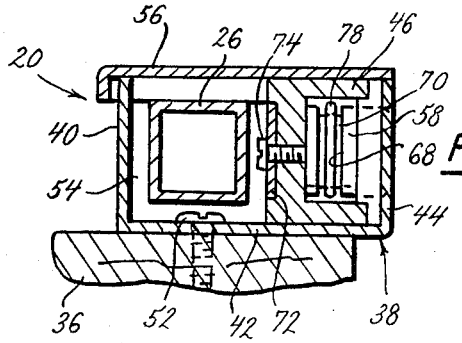
FIG. 7 is a cross-sectional view of the guard latch taken along the plane of line 7—7 in FIG. 4, showing the solenoid for releasing the lock.
Figure 8:
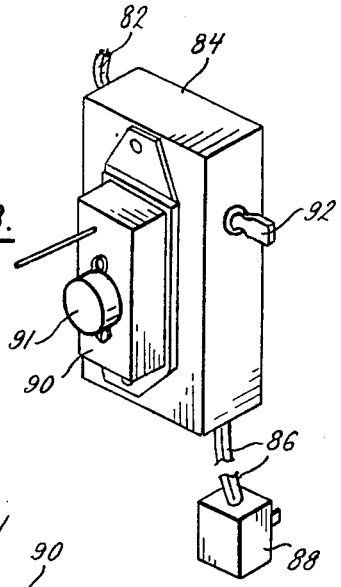
FIG. 8 is a perspective view of the control box for activating the emergency release; and, FIG. 9 is a schematic view of the emergency release mechanism.

Bracket 38 is mounted to the frame 36 of window 24 as with screws 52 extending through the back 42 of bracket 38, as shown in FIGS. 4 and 7. Bracket 38 has a channel 54 between the left side 40 and the lock unit 46, for receiving a portion of the left end bar 26. As shown in FIGS. 2 and 7, a portion of left end bar 26 has a plate 56 secured thereto as by welds to cover the open front of bracket 38 when bar 26 is in channel 54. Plate 56 prevents tampering when guard 22 is engaged in window guard latch 20.

Figure 5:
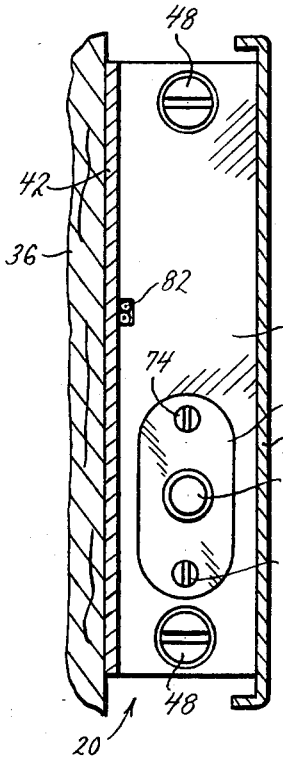
FIG. 5 is a cross-sectional view of the guard latch taken along the plane of line 5—5 in FIG. 4, showing the side of the lock unit.

Lock unit 46 contains a lock cylinder 58 with a keyhole 60 opening through the right side 44 of bracket 38. Lock cylinder 58 is operable by key 62 to extend and retract bolt 64. The keyhole 60 is positioned to be readily accessible from inside and outside. As shown in FIG. 4, bolt 64 can extend into a hole 66 in left end bar 26 to engage left end bar 26 and secure guard 22 in the closed position. Lock cylinder 58 has a slot 68 that exposes a trigger 70 which when depressed retracts bolt 64. As shown in FIG. 5, lock cylinder 58 is secured in lock unit 46 with plate 72 and screws 74.

Figure 6:
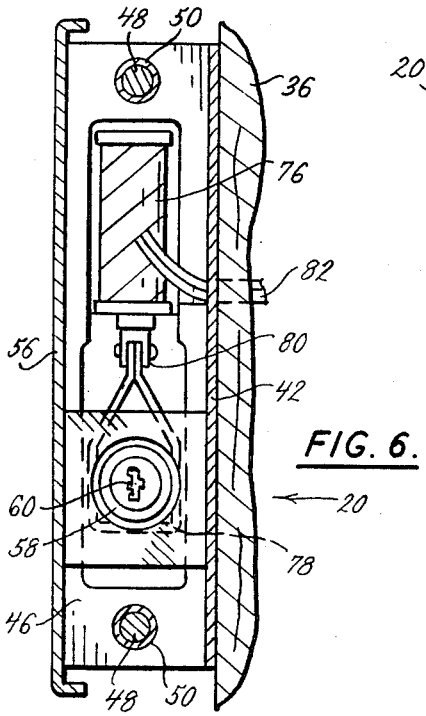
FIG. 6 is a cross-sectional view of the guard latch taken along the plane of line 6—6 in FIG. 4, showing the solenoid for releasing the lock.

A solenoid 76 is mounted in lock unit 46 above lock cylinder 58. As shown in FIG. 6, a loop 78, attached to the arm 80 of solenoid 76, extends around lock cylinder 58. As shown in FIG. 4, loop 78 extends into slot 68 and actuation of solenoid 76 pulls loop 78 into slot 68 to depress trigger 70. The wire leads 82 from the solenoid 76 extend from the lock unit 46 into the channel 54 and through the back 42 of bracket 38 and thereafter through the wall of the building. Inside the building, wire leads 82 extend into a control box 84.

Control box 84 has a power cord 86 extending to a transformer 88 which can plugged into a standard electric socket. Control box 84 has an RF receiver 90 and audible alarm 91 mounted on its front face. As described below, RF receiver 90 receives radio signals from remote transmitters, sounds audible alarm 91, and triggers control box 84 in response thereto. Control box 84 also has a manual rocker switch 92 for triggering the control box 84 and alarm 91.

Figure 9:
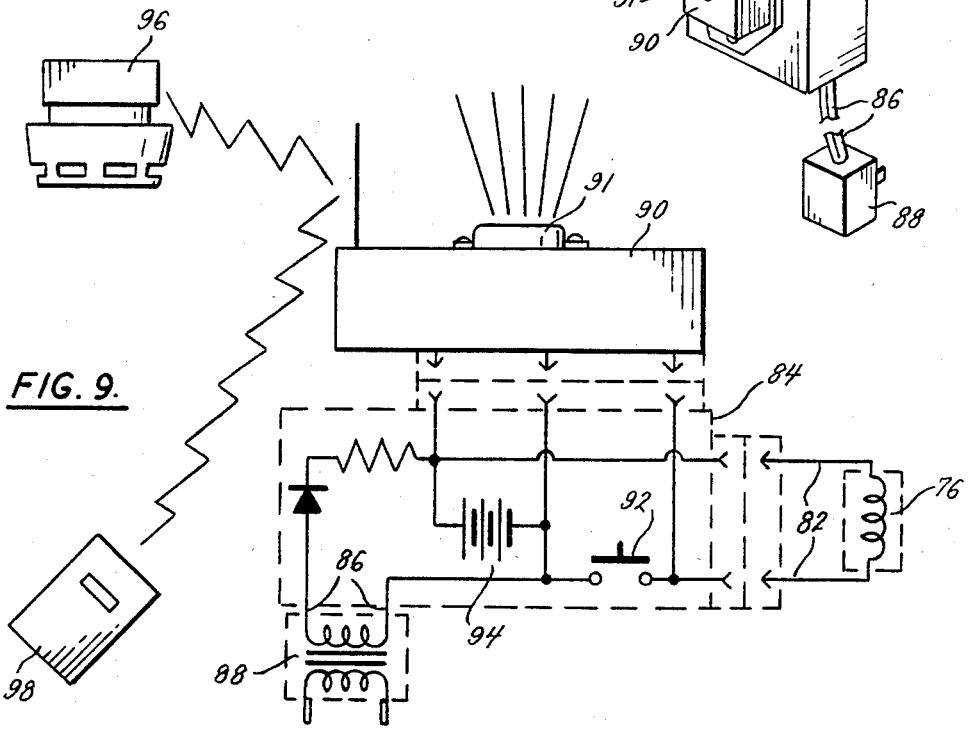

The emergency release is shown schematically in FIG. 9. As shown in this figure, control box 84 is supplied with power from transformer 88 but also has a continuously charged, rechargeable Ni-Cad battery 94 to power the emergency release in the event of a power failure. The control box 84 can actuate the solenoid 76 either when switch 92 is actuated to complete the circuit or when RF receiver 90 is activated by an RF transmitter such as a smoke detector 96 equipped with an RF transmitter that is triggered when the smoke detector is triggered. Alternatively, or in addition, a remote push button actuated RF transmitter 98 can be provided. When the solenoid 76 is activated by switch 92, smoke detector 96, or push button 98, it draws loop 78 upwardly to depress trigger 70 which retracts bolt 64 thereby unlocking guard 22.

The smoke detector 96 can be installed anywhere in the building without any special wiring. Likewise, push button 98 can be located anywhere in the building without any special wiring. Installation of the window guard latch 20 is thus simply a matter of fastening bracket 38 to the window frame 36 with screws 52 in position to receive the left end bar 26. Lead wire 82 from solenoid 76 is brought through the wall, into the interior of the building and connected to control box 84.

OPERATION

Once guard 22 and guard latch 20 are installed over window 24, guard latch 20 is used by swinging guard 22 closed until left end member 26 is in channel 54 in bracket 38. Bolt 64 is then moved into hole 66 in left end member 26 by depressing bolt 64 to engage trigger 70. In the closed position, plate 56 completely closes bracket 38 preventing tampering with lock unit 46.

In the event of a fire, smoke detector 96 would be triggered, triggering its RF transmitter. RF detector 90 receives the RF signal from the smoke detector 96 and in response sounds alarm 91 and completes the circuit to energize solenoid 76. Energizing solenoid 76 draws arm 80 inwardly pulling loop 78 into slot 68 to actuate trigger 70, to retract bolt 64 and release guard 22. In some other emergency, push button 98 could be used to transmit an RF signal to release guard 22. Finally, switch 92 on control box 84 could be used to actuate the solenoid directly and release guard 22. In the event of a power failure, which is likely in an emergency situation, battery 94 provides backup power to operate the release mechanism. However, key 62 can also be inserted into keyhole 60 and turned to retract bolt 64 and release guard 22.

There are various changes and modifications which may be made to the invention as would be apparent to those skilled in the art. However, any of these changes or modifications are included in the teaching of inventors' disclosure and they intend that their invention be limited only by the scope of the claims appended hereto.

We claim:

1. A window guard latch for securing a guard over a window, the window guard latch comprising:
   - a bracket;
   - a channel in the bracket for receiving a portion of the window guard;
   - a lock unit in said bracket, the lock unit including a lock for engaging the portion of the window guard received in the channel in the bracket; and,
   - means for releasing the engagement between the lock and window guard in response to an RF signal transmitted from a remote source.

2. The device of claim 1 wherein the lock comprises a bolt operable between an extended position in the channel and a retracted position out of the channel, and wherein the portion of the window guard received in the channel has an opening for receiving the bolt, the bolt extending into the opening in the window guard when the window guard is in the channel and the bolt is in the extended position to engage the window guard.

3. The device of claim 2 wherein the lock further comprises a lock cylinder, a trigger in the cylinder to retract the bolt from its extended position, and a slot in the cylinder to expose the trigger; and wherein the means for releasing the engagement between the lock and the window guard comprises means for operating the trigger to retract the bolt.

4. The device of claim 3 wherein the means for operating the trigger comprises means for engaging the trigger, a solenoid attached to the engaging means; and wherein the releasing means comprises means for detecting an RF signal, and means responsive to the detecting means for activating the solenoid to move the engaging means to operate the trigger.

5. The device of claim 1 further comprising a control box, the control box comprising means for detecting an RF signal and means responsive to the detecting means for releasing the engagement between the lock and the window guard.

6. The device of claim 5 further comprising a smoke detector which transmits an RF signal when it detects smoke, the RF signal transmitted being of the operative frequency.

7. The device of claim 5 further comprising a push button actuated RF signal transmitter, the RF signal transmitted being of the operative frequency.

8. The device of claim 5 wherein the control box further comprises a switch for releasing the engagement between the lock and the window guard.

9. The device of claim 5 further comprising a transformer for connecting to an electric socket and means for conducting current from the transformer to the control box to power the signal detector and the releasing means.

10. The device of claim 9 wherein the control box further comprises a battery in parallel to the current conducting means to supply current in the event that current from the transformer is interrupted.

11. A window guard latch for securing a guard over a window, the window guard latch comprising:

a bracket;

a channel in the bracket for receiving a portion of the window guard;

a lock unit in said bracket, the lock unit including a lock comprising a bolt operable between an extended position in the channel and a retracted position out of the channel, and an opening in the portion of the window guard received in the channel for receiving the bolt, the bolt extending into the opening in the window guard when the window guard is in the channel and the bolt is in the extended position to engage the window guard; the lock further comprising a lock cylinder, a trigger in the cylinder to retract the bolt from its extended position, and a slot in the cylinder to expose the trigger;

a loop extending around the lock cylinder for engaging trigger;

a solenoid attached to the loop for moving the loop against the trigger to retract the bolt;

means for detecting an RF signal; and, means responsive to the detecting means for activating the solenoid to move the loop against the trigger and thereby release the latch.

12. The device of claim 11 further comprising a smoke detector which transmits an RF signal when it detects smoke, the RF signal transmitted being of the operative frequency.

13. The device of claim 11 further comprising a push button actuated RF signal transmitter, the RF signal transmitted being of the operative frequency.

14. A window guard with latch for securing the window guard over a window, the latch comprising means for engaging the guard to secure it in position over the window, and means for automatically releasing the engaging means in response to an RF signal transmitted from a remote source, thereby permitting the guard to be freely opened.

15. The device of claim 14 wherein the remote source comprises a smoke detector, the smoke detector having means to transmit an RF signal of the operative frequency in response to its detection of smoke.

16. The device of claim 14 wherein the remote source comprises a push button actuated RF transmitter.

17. The device of claim 14 wherein the engaging means comprises a bolt operable between an extended position engaging the window guard and a retracted position disengaged from the window guard.

18. The device of claim 17 wherein the engaging means further comprises a lock cylinder connected to the bolt, a trigger in the cylinder to retract the bolt from its extended position, and wherein the releasing means comprises means for operating the trigger to retract the bolt.

19. The device of claim 18 wherein the means for operating the trigger comprises a loop for engaging the trigger, a solenoid attached to the loop for moving the loop to thereby operate the trigger, and means for activating the solenoid in response to an RF signal.

20. The device of claim 19 further comprising a local audible alarm, the releasing means having means to sound the local audible alarm.

* * * * *